US011648796B2

(12) United States Patent
Kanari

(10) Patent No.: US 11,648,796 B2
(45) Date of Patent: May 16, 2023

(54) MECHANICAL PENCIL HAVING LEAD BREAKAGE-PREVENTION MECHANISM

(71) Applicant: Micro Co., Ltd., Tokyo (JP)

(72) Inventor: Hiroyuki Kanari, Fukushima-ken (JP)

(73) Assignee: MICRO CO., LTD.

( * ) Notice: Subject to any disclaimer, the term of this patent is extended or adjusted under 35 U.S.C. 154(b) by 49 days.

(21) Appl. No.: 17/483,579

(22) Filed: Sep. 23, 2021

(65) Prior Publication Data

US 2022/0363086 A1 Nov. 17, 2022

(30) Foreign Application Priority Data

May 14, 2021 (JP) ..... JP2021-82542

(51) Int. Cl.
*B43K 21/027* (2006.01)
*B43K 21/22* (2006.01)
*B43K 21/06* (2006.01)

(52) U.S. Cl.
CPC ..... *B43K 21/027* (2013.01); *B43K 21/06* (2013.01); *B43K 21/22* (2013.01)

(58) Field of Classification Search
CPC ..... B43K 21/027; B43K 21/06; B43K 21/22
See application file for complete search history.

(56) References Cited

U.S. PATENT DOCUMENTS 4,269,524 A * 5/1981 Hashimoto ..... B43K 21/20 401/116
4,386,865 A * 6/1983 Kageyama ..... B43K 21/027 401/67
4,504,163 A * 3/1985 Hashimoto ..... B43K 25/028 401/80
4,895,467 A * 1/1990 Kageyama ..... B43K 24/06 401/67
4,929,107 A * 5/1990 Kageyama ..... B43K 21/20 401/83
5,462,376 A * 10/1995 Kageyama ..... B43K 21/027 401/65
5,826,999 A * 10/1998 Kageyama ..... B43K 21/20 401/65

(Continued)

FOREIGN PATENT DOCUMENTS

JP 63-21083 2/1988

*Primary Examiner* — Patrick M. Buechner
(74) *Attorney, Agent, or Firm* — Adams & Wilks

(57) ABSTRACT

A mechanical pencil has a main body housing a lead-feeding mechanism which includes a chuck and a clamping ring. A tapered member is provided at a front end of the main body, and a slider is mounted to undergo back and forth movement within the tapered member. A lead protection pipe protrudes from a front end of the tapered member when the slider moves forward, and an outer pipe is provided at a front end of the tapered member and surrounds a front end of the lead protection pipe. The slider moves backward as the writing proceeds so the lead protection pipe is not bent by a writing pressure, whereby a lead can be fed by a few knocking operations. The outer pipe is fixed to the tapered member or provided on an outer pipe holder inserted into the tapered member. The outer pipe holder is fixed to the inside of the tapered member or disposed to move back and forth in the tapered member.

6 Claims, 12 Drawing Sheets

(56) References Cited

U.S. PATENT DOCUMENTS 6,234,697 B1 * 5/2001 Kanari ..... B43K 21/22
401/92
6,767,150 B1 * 7/2004 Sheu ..... B43K 21/22
401/89

* cited by examiner

MECHANICAL PENCIL HAVING LEAD BREAKAGE-PREVENTION MECHANISM

FIELD OF THE INVENTION

The present invention relates generally to a mechanical pencil having a lead breakage-prevention mechanism and, more particularly, to a mechanical pencil having a lead protection pipe provided at a front end of a slider to cover a front end periphery of a pencil lead and prevent lead breakage, wherein the lead protection pipe and the slider move backwardly as the writing proceeds.

BACKGROUND INFORMATION

Mechanical pencils have been widely known, in which a tapered member is provided at a front end of a main body, a lead protection pipe is retractably inserted through a front end opening formed on the tapered member, and a rear end of the lead protection pipe is fixed to a slider which moves back and forth in the tapered member. In such a mechanical pencil, lead breakage can be prevented by inserting a front end of a lead into the lead protection pipe. The lead protection pipe and the slider move backward as the lead is consumed during use of the mechanical pencil.

Knocking-type mechanical pencils usually use a lead-feeding mechanism having a chuck of a collet chuck type, a clamping ring (clutch) which clamps down the chuck, and a chuck spring which urges the chuck rearward. The chuck moves backward by the chuck spring and slips into the inside of the clamping ring. The chuck is thereby closed and grips the lead. When the chuck is knocked, the chuck moves forward while gripping the lead, and during its forward advancement, the clamping ring releases the chuck. By this operation, the lead moves forward and is fed to the position where it protrudes from the lead protection pipe.

When the above knocking operation is stopped, the chuck moves backward. At this time, if the lead is not held at an advanced position, the lead moves backward together with the chuck, requiring further knocking a few times in order to feed the lead. Accordingly, in order to keep the lead at the advanced position, a lead-holding portion is provided at the inner face of the slider to temporarily hold the lead, and a slide-resistant portion is provided at the outer face of the slider to prevent backward movement of the slider. Further, when the chuck moves backward, the chuck slips into the clamping ring during its backward movement and therefore the chuck is gradually closed, and concurrently the lead is also retracted slightly. By the retracting force at this stage, once the slider moves backward together with the lead, it becomes difficult to feed the lead again.

In a mechanical pencil described in JP-UM-Sho 63-21082A which shows one example of conventional sliders, on an inner face of the slider, a lead-holding portion made of a synthetic resin material is in sliding contact with an outer face of the lead with friction resistance between the two surfaces in sliding contact. On an outer face of the slider, an elastic resistance piece (a piece that increases frictional resistance) made of a synthetic resin is in sliding contact with an inner face of the tapered member. Further, the friction resistance of the elastic resistance piece which is in sliding contact with the inner face of the tapered member is set to be larger than the friction resistance of the lead-holding portion which is in sliding contact with an outer face of the lead. By so setting the friction resistances, when the lead is retracted, the slider does not move backward and the lead is held at the advanced position.

On writing, the lead protection pipe abuts on the writing surface, e.g., paper, and retracts backward. The resistance at this time is a resistance obtained by adding a resistance by the elastic resistance piece when the slider is held at a constant position to a resistance by the lead-holding member which temporarily holds the lead. Since this large resistance is always applied to the lead-holding pipe, the resistance at the front end of the writing instrument becomes large, the dragging resistance at the time of writing becomes high, and smooth writing becomes difficult.

As mentioned above, the lead breakage can be prevented by the lead protection pipe. Further, a mechanical pencil constituted to prevent lead breakage when an excessively large load is applied at the writing front end of the lead has also been known. FIGS. 17A-17C show an example of one such mechanical pencil. Into a tapered member 102 connected to the front end of a main body 101, a slider 104 having a lead protection pipe 103 is inserted. The slider 104 is constituted in a substantially same structure as described in JP-UM-Sho 63-21082A, and on an inner face of the slider 104, a lead-holding portion 105 which temporarily holds a lead is provided, and on an outer face of the slider, an elastic resistance piece 106 which has a resistance set to be larger than a resistance of the lead-holding portion 105 is provided. A holding tube 109 holds a lead-feeding mechanism such as a chuck 107, a clamping ring 108 and a chuck spring 113 and is urged forward by a cushion spring 110 having an elastic force which is larger than a writing pressure.

In a writing state, as shown in FIG. 17A, the slider 104 and the lead protection pipe 103 move forward and abut on an inward stepped portion 111 of the tapered member 102. The front end of the lead protection pipe 103 protrudes from the tapered member 102 and then writing can be carried out. As shown in FIG. 17B, when an excessively large load is applied to the front end in the direction of the arrow, the lead protection pipe 103 and the slider 104 move backward, and the slider 104 stops at the retracted position. At this time, since the chuck 107 is kept in a state where it clamps a lead 112, the chuck 107 is pressed by the lead 112 and moves backward together with the holding tube 109 against the biasing force of the cushion spring 110. The retracted distance at this time is L1.

When the excessively large load is released, the holding tube 109 holding the chuck 107, etc. moves forward by the cushion spring 110, and therefore, as shown in FIG. 17C, the lead 112 in a state where it is clamped by the chuck 107 also advances forward. During advancement, since the chuck 107 does not press the slider 104, the slider 104 remains stopped at the retracted position where it is retracted by the resistance of the elastic resistance piece. In this state, since the lead protection pipe 103 does not protrude from the front end of the tapered member 102, only the lead 112 moves forward and protrudes from the front end of the tapered member 102. The distance of protrusion at this time is a distance L2 which is equal to the above retracted distance L1. Accordingly, the front end portion is exposed outwardly from the tapered member 102 without protection by the lead protection pipe 103 and the lead is therefore likely to break.

Usually, in order to secure visibility when writing, i.e., viewing of the writing tip, the lead protection pipe is often used in a state where it protrudes by about 3 to 4 mm from the tapered member. Since mechanical pencils are often used slantwise at an inclined angle, the writing pressure applied to the writing front end of a lead may act in a transverse direction to the lead protection pipe depending on the angle on writing, which means that with respect to the lead protection pipe, the force is exerted in such a direction that the lead protection pipe would be bent on a fulcrum where the lead protection pipe is in contact with the front end of the tapered member. This force becomes a resistance to movement between the outer face of the lead protection pipe and the front end inner face of the tapered member, and also acts on the slider via the lead protection pipe. Accordingly, the slider may sometimes be transversely pressed, bent or moved slantwise, thereby inhibiting straight-line movement of the slider. As mentioned above, when a force in a transverse direction is exerted, the lead protection pipe is bent and straight-line movement of the slider cannot be secured, leading to one of the causes of lead breakage.

SUMMARY OF THE INVENTION

It is an object of the present invention to provide a mechanical pencil having a lead breakage-prevention mechanism that prevents or significantly reduces breakage of the pencil lead.

Another object of the present invention is to provide a mechanical pencil having a lead breakage-prevention mechanism comprising a slider having on its front end a lead protection pipe for protecting a lead, the slider moving forward when the lead is fed and moving backward as writing proceeds. The lead can be fed by a few knocking operations on the rear end of the mechanical pencil. During writing, the lead protection pipe presents no dragging resistance as it moves on the writing surface, the slider moves backward smoothly, and the lead protection pipe and the slider can move in a stable manner.

The above and other objects of the present invention can be implemented by a mechanical pencil having a main body housing a lead-feeding mechanism which includes a chuck and a clamping ring; a tapered member provided at a front end of the main body; a slider mounted to undergo back and forth movement within the tapered member; a lead protection pipe which protrudes from a front end of the tapered member when the slider moves forward; and an outer pipe provided at a front end of the tapered member and surrounding a front end of the lead protection pipe. The slider has, on its outer face, a non-resistant sliding-contact face which is in free sliding contact with an inner face of the tapered member, and has on its inner face, a lead weak-holding portion that weakly holds the lead so that the lead fed by the chuck does not drop by its own weight.

In the present disclosure, the direction in which the lead is fed or advanced from the tapered member is referred to as "forward" or "frontward", and the direction in which the lead is retracted into the main body is referred to as "backward" or "rearward".

The lead weak-holding portion on the slider applies a weak lead-holding force to the lead that is sufficient to hold and prevent the lead from dropping due to its own weight. Additionally, the lead-holding force is selected to ensure that writing can be carried out, without hinderance, while dragging the lead protection pipe on the writing surface. By way of example and not limitation, a gram-force of a few grams has been found to be an acceptable value for the lead-holding force.

The outer pipe is fixed to the tapered member or provided on an outer pipe holder inserted into the tapered member. The outer pipe holder is fixed to the inside of the tapered member or disposed to move back and forth in the tapered member. When the outer pipe holder is disposed to move back and forth, a rear end of the outer pipe holder faces a holding pipe which holds the chuck and the clamping ring, and the holding pipe is urged forward by a cushion spring having a spring pressure larger than the writing pressure.

According to a feature of the present invention, the slider is disposed within the tapered member provided at the front end of the main body, the slider is disposed to undergo back and forth movement, and the slider has a lead protection pipe which protrudes from the front end of the tapered member when the slider moves forward. At the front end of the tapered member, the outer pipe is provided and surrounds the front end of the lead protection pipe. The slider is provided with, on its outer face, a non-resistant sliding-contact face which slidingly contacts the inner face of the tapered member, and on its inner face, a lead weak-holding portion having a weak holding force such that the lead fed by the lead-feeding mechanism does not drop by its own weight. By this structure, when a chuck of the lead-feeding mechanism is knocked, the outer face of the lead fed by the chuck contacts the lead weak-holding portion in the slider. Since the slider has, on its outer face, a non-resistant sliding-contact face which slidingly contacts the inner face of the tapered member without causing friction resistance, the slider moves forward by the lead slipped into the lead weak-holding portion, and the lead is fed to the advanced position by one knocking whereby writing can be performed in a state where the lead is protected by the lead protection pipe.

Taking into account the distance the lead is retracted at the time of backward movement of knocking, in the case of the lead-feeding distance by a knocking operation, the lead is fed a distance larger than the lead-feeding amount for one knocking operation necessary for normal writing by adding the distance when the lead is retracted. And during writing, when the lead protection pipe abuts on the writing surface, since the non-resistant sliding-contact face is provided on the outer face of the slider and the lead-holding force of the lead weak-holding portion is very weak, the lead protection pipe and the slider can move backward readily and the dragging resistance of the lead protection pipe along the writing surface is low, whereby writing can be made smoothly.

Further, the outer periphery of the lead protection pipe provided at the front part of the slider is surrounded by an outer pipe provided at the tapered member, and the lead protection pipe protrudes outwardly through the outer pipe, whereby it is protected by the outer pipe. Accordingly, even if a force is exerted during writing by which the lead protection pipe may be bent, the lead protection pipe can be protected by the outer pipe and there is no possibility that the lead protection pipe is bent. It is therefore possible to suppress the inclination of the slider and prevent bending of the lead protection pipe when the mechanical pencil is dropped. As mentioned above, since straight-line movement of the slider can be secured, lead breakage can be further securely prevented.

BRIEF DESCRIPTION OF THE DRAWINGS

FIG. 3 shows an example of a slider, wherein

FIG. 4 shows another example of a slider, wherein

FIG. 5 shows an example of an outer pipe holder, wherein

FIG. 6 shows another example of an outer pipe holder, wherein

FIG. 11 shows an example of a lead-feeding mechanism, wherein

FIG. 12 shows a writing state, wherein

FIG. 13 shows a cushion mechanism, wherein

FIG. 14 shows the action of the cushion mechanism, wherein

FIG. 15 shows a mechanism for protecting the outer pipe, wherein

FIG. 17 shows a conventional mechanical pencil, wherein

DETAILED DESCRIPTION OF THE PREFERRED EMBODIMENTS

Figure 1:
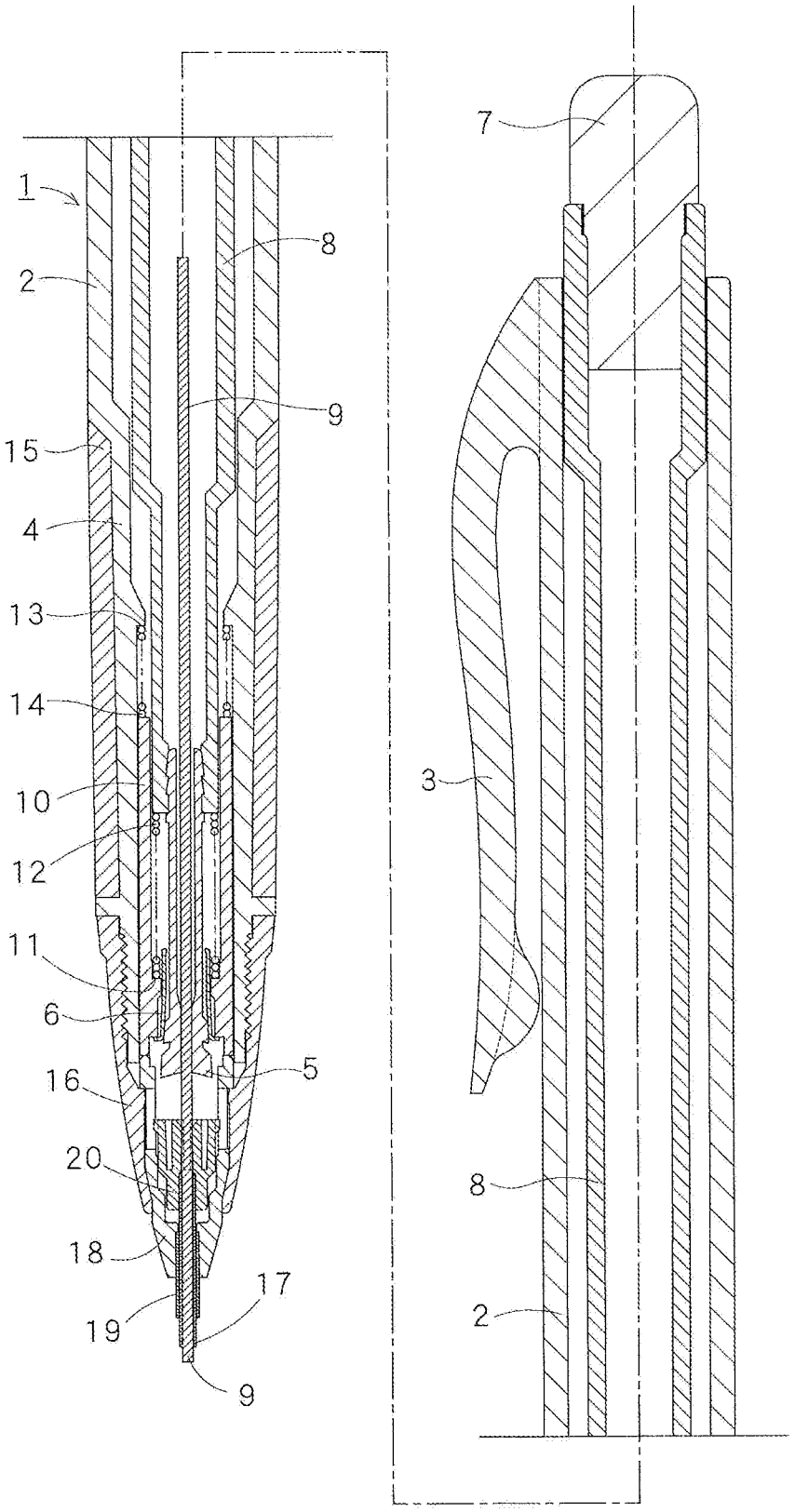
FIG. 1 is a cross-sectional view showing one example of a mechanical pencil having a lead-breakage prevention mechanism according to the present invention.

FIG. 1 shows one embodiment of a mechanical pencil having a lead breakage-prevention mechanism constructed according to the principles of the present invention. The mechanical pencil comprises a tubular main body 1 having a rear tubular portion 2 on which is provided a clip 3, and a front tubular portion 4. The front portion 4 has an inner diameter smaller than that of the rear portion 2. As conventionally known, a lead-feeding mechanism comprising a chuck 5 and a clamping ring 6 is housed in the tubular front portion 4. Within the tubular rear portion 2 of the main body is inserted a lead tank 8 provided with an eraser 7 at its rear end, and at the front end of the lead tank 8, the chuck 5 is fixed.

The chuck 5 clamps a lead 9 when the lead is retracted into the clamping ring 6. The chuck 5 and the clamping ring 6 are inserted into a holding tube 10 which is inserted to undergo back and forth movement in the front portion 4 of the main body 1. Between an inward stepped portion 11 of the holding tube 10 and the front end of the lead tank 8, a chuck spring 12 is provided for urging the chuck 5 rearwardly. Further, between the rear end of the holding tube 10 and a shoulder portion 13 formed within the main body 1, a cushion spring 14 which has a spring pressure larger than normal writing pressure is provided. On an outer periphery of the front portion 4 of the main body, a grip 15 is provided. At the front end of the main body 1, a tapered member 16 is threadedly mounted, and from the front end of the tapered member 16, a lead protection pipe 17 made of stainless steel, etc. protrudes. By the above-mentioned structure, when the lead tank 8 is knocked, as conventionally known, the chuck 5 moves forward, and during its forward movement, the chuck is released from clamping by the clamping ring 6, and the lead 9 is fed forward and protrudes from the lead protection pipe 17, whereby writing can be made.

In the tapered member 16, an outer pipe holder 18 is provided, and at the front end of the outer pipe holder 18, an outer pipe 19 is fixedly attached. The lead protection pipe 17 extends slidably through the outer pipe 19 which surrounds the outer periphery of the lead protection pipe. The outer pipe 19 has a strength sufficient to suppress a bending force which acts on the lead protection pipe 17 during writing. Preferably the outer pipe 19 is formed of thin metal pipe material, such as a stainless steel, and has an inner diameter sized such that an outer face of the lead protection pipe 17 is in slidable contact with an inner face of the outer pipe 19 and an outer diameter sized such that visibility of the outer pipe 19 is not lost during writing. Further, the length of the outer pipe 19 is adjusted in size such that when the lead protection pipe 17 protrudes during writing, the front end of the outer pipe 19 is positioned behind the front end of the lead protection pipe 17. The outer pipe holder 18 may be fixedly provided in the tapered member 16, but preferably is movable back and forth so that it can move backward when an excessively large load is applied to the outer pipe 19.

Figure 2:
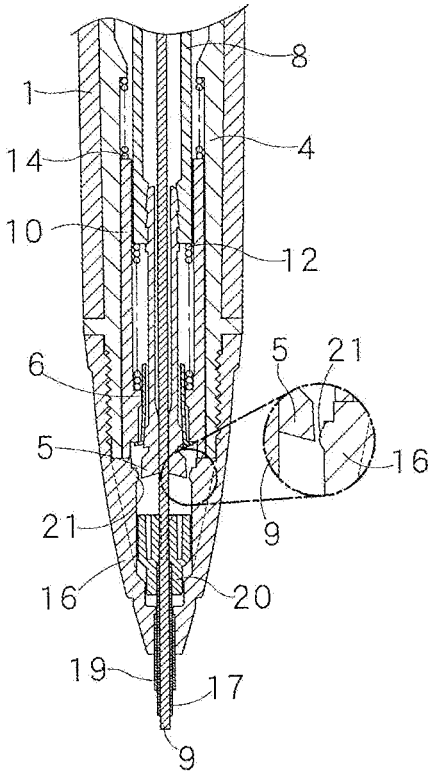
FIG. 2 is a partial cross-sectional view and a partial enlarged explanatory view of an example of a lead-breakage prevention mechanism that does not use an outer pipe holder.

The outer pipe 19 may be directly fixed to the front end of the tapered member 16 without employing the outer pipe holder 18 as shown in FIG. 2. In the outer pipe holder 18, a slider 20 is housed to move back and forth, and at the front end of the slider 20, the lead protection pipe 17 which is inserted into the outer pipe 19 to protect the lead 9 is fixed. In the case of the example as shown in FIG. 2, the slider 20 is housed in the tapered member 16, and a detachment-preventing raised portion 21 to prevent detachment of the slider 20 rearwardly is provided on the inner face at the rear portion of the tapered member 16.

Figure 3A:
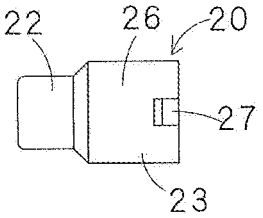
FIG. 3A is a plan view.
Figure 3B:
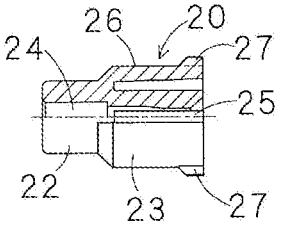
FIG. 3B is a partial cross-sectional view.
Figure 3C:
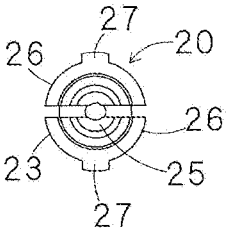
FIG. 3C is a right-side elevational view.

FIGS. 3A-3C show an example of the slider 20. The slider 20 has a front side tubular portion 22, and a rear side tubular portion 23 having a diameter larger than that of the front side tubular portion 22. The lead protection pipe 17 is fixed to a mounting aperture 24 provided at the front side tubular portion 22. Inside the rear side tubular portion 23, is provided a lead weak-holding portion 25 of a tubular shape for temporarily holding the lead 9. The lead weak-holding portion 25 has one or more slits extending in the longitudinal direction of the tubular portion to increase flexibility of the lead weak-holding portion so that it can elastically hold the lead 9 as in conventional mechanical pencils, but the lead weak-holding portion may be constituted by an elastic material such as a rubber material (not shown).

The lead-holding force of the lead weak-holding portion 25 in this embodiment is set to be far smaller than that of the lead-holding portion of conventional mechanical pencils. More particularly, when the front end of the main body 1 is directed downward, an extremely weak lead-holding force is applied to the lead 9; however, this extremely weak force is sufficient to prevent the lead 9 from falling downward by its own weight. Byway of example, the extremely weak force may be a gram-force of a few grams, which is adequate to prevent falling of the lead 9 due to gravity, and even if writing is conducted while dragging the lead protection pipe 17 on the writing surface, such does not hinder writing.

Figure 4A:
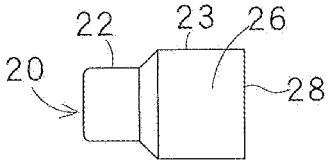
FIG. 4A is a plan view.
Figure 4B:
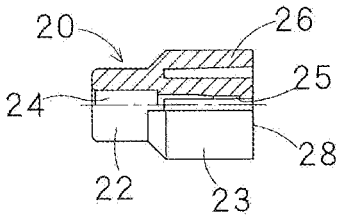
FIG. 4B is a partial cross-sectional view.
Figure 4C:
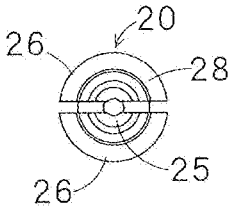
FIG. 4C is a right-side elevational view.
Figure 5A:
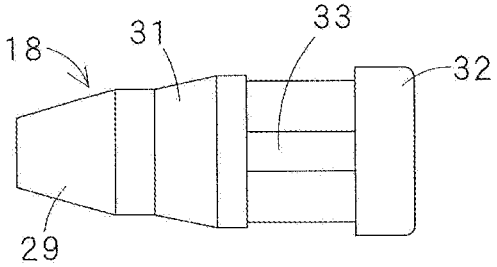
FIG. 5A is a plan view.
Figure 5B:
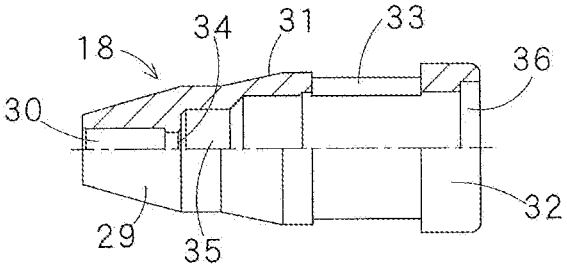
FIG. 5B is a partial cross-sectional view.
Figure 5D:
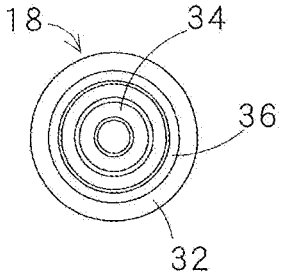
FIG. 5D is a right-side elevational view.
Figure 5C:
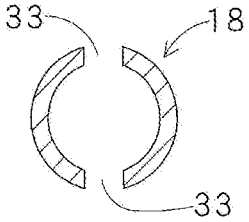
FIG. 5C is a partial elevational cross-sectional view.

Further, in conventional mechanical pencils, the slider is provided with an elastic piece for resistance which contacts internally the tapered member with a large elastic resistance force so that the slider would not be retracted together when the chuck is moved backward. However, the above rear side tubular portion of the present invention is not provided with such an elastic piece for resistance. Instead, the rear side tubular portion 23 of this embodiment slidingly contacts the inner face of the outer pipe holder 18 and has a non-resistant sliding-contact surface 26 so that no contact resistance would be generated with the outer pipe holder 18. Here, in the example shown in FIG. 3, two detachment-preventing latches 27 are provided at the outer face of the rear side tubular portion 23 so that detachment from the outer pipe holder 18 would be prevented, but the rear end face may be designed to be a detachment-preventing abutting part 28 as shown in an example of FIGS. 4A-4C.

FIGS. 5A-5D show one embodiment of the outer pipe holder 18. In this embodiment, the outer pipe holder 18 is formed in a shape of a tubular body configured to be inserted into the tapered member 16, and at its front end, a taper-shaped protrusion part 29 is formed which protrudes from the front-end opening portion of the tapered member 16, and inside thereof, amounting aperture 30 for the outer pipe 19 is formed. On the outer face of the outer pipe holder 18, a shoulder part 31 is formed which acts as detachment prevention by abutting on the inner face of the tapered member 16. The rear portion of the shoulder part 31 has a small-diameter portion, and rearward of the small-diameter portion is provided a stopper part 32 which abuts on the front end of the holding tube 10. At the small-diameter portion, two detachment-preventing grooves 33 are provided so that detachment-preventing latches 27 (as shown in FIG. 3) provided on the slider 20 slip thereinto. On the inner face of the outer pipe holder 18, a stopper part 34 is provided on which the front end of the front side tubular portion 22 abuts when the slider 20 moves forward. Behind the stopper part 34, a rear side sliding surface 35 is formed on which the non-resistant sliding-contact surface 26 of the slider 20 slides. Further, at the rear end, an inward stepped portion 36 is provided on which the clamping ring 6 abuts so that when the chuck 5 and the clamping ring 6 are moved forward by the knocking operation, the clamping of the chuck 5 by the clamping ring 6 is released during the advance movement.

Figure 6A:
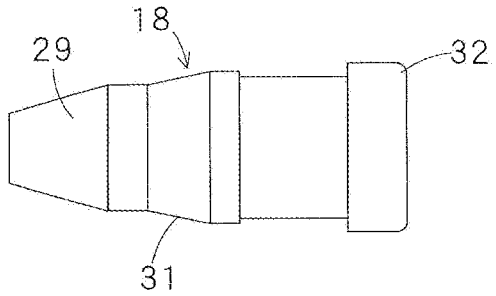
FIG. 6A is a plan view.
Figure 6B:
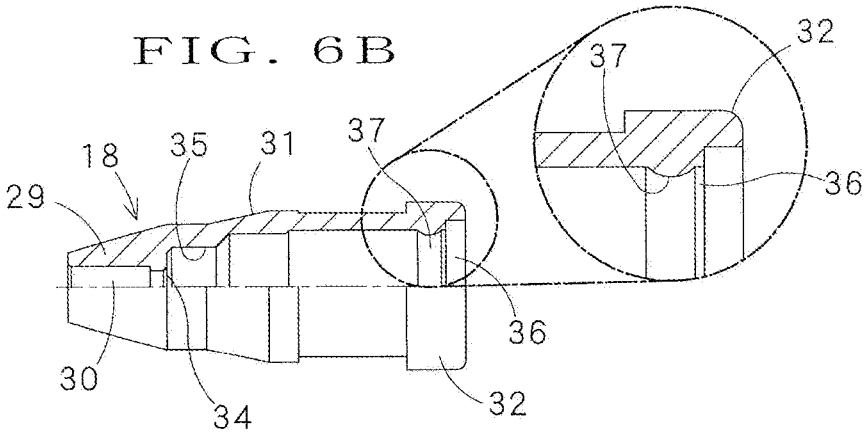
FIG. 6B is a partial cross-sectional view and a partial enlarged explanatory view.

FIGS. 6A and 6B show another example of the outer pipe holder 18. In this example, instead of the detachment-preventing grooves 33 shown in the outer pipe holder 18 of FIG. 5, a raised portion 37 for detachment prevention is provided on which the abutting part 28 for detachment prevention of the slider 20 abuts as shown in FIG. 4, and at the rear end thereof, the stopper part 32 which abuts on the front end of the holding tube 10 is provided.

Figure 7:
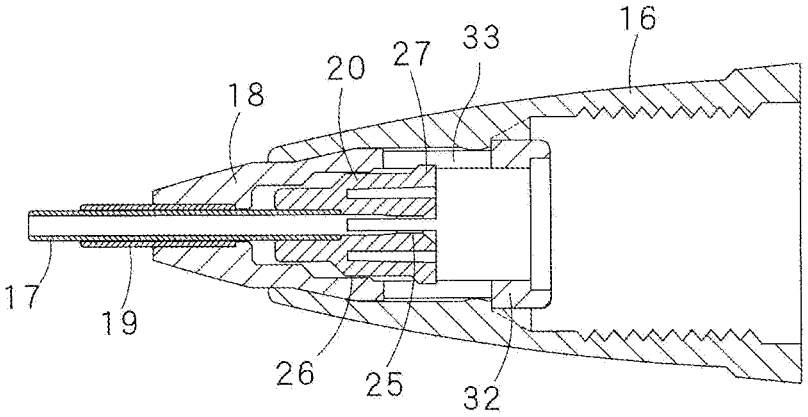
FIG. 7 is an explanatory view showing a state where the slider shown in FIG. 3 and the outer pipe holder shown in FIG. 5 are assembled in a tapered member.
Figure 8:
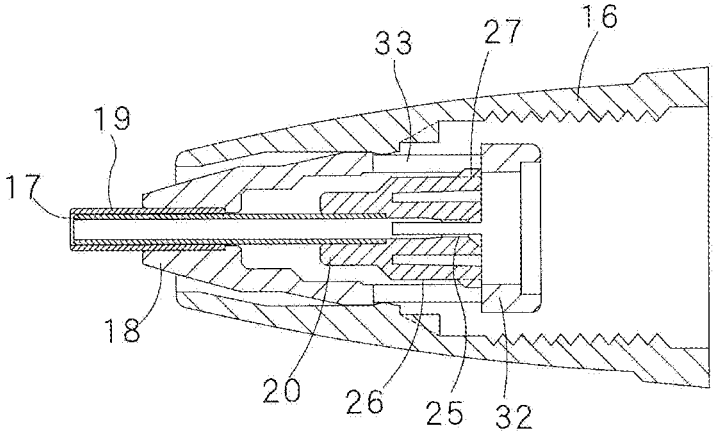
FIG. 8 is an explanatory view showing a state where the outer pipe holder, etc. shown in FIG. 7 are retracted.

To the front side tubular portion 22 of the slider 20 shown in FIG. 3, the lead protection pipe 17 is fixed, and to the outer pipe holder 18 as shown in FIG. 5, the outer pipe 19 is fixed. In a state where the lead protection pipe 17 is inserted through the outer pipe 19 and the detachment-preventing latches 27 are engaged with the detachment-preventing grooves 33, the slider 20 and the outer pipe holder 18 are combined and assembled in the tapered member 16 (see FIG. 7). The outer pipe holder 18 is inserted until it stops by abutting on the inner face of the tapered member 16, and at this time, the lead protection pipe 17 is formed in such a length that the front end of the lead protection pipe 17 protrudes a little forward from the front end of the outer pipe 19. In this state, if an excessively large load is applied to the front end of the lead protection pipe 17, the entire lead protection pipe 17 slips into the outer pipe 19 and the rear end of the slider 20 abuts on the stopper part 32, and concurrently the slider 20 moves backward within the outer pipe holder 18, and the outer pipe holder 18 also moves backward within the tapered member 16 as shown in FIG. 8.

Figure 9:
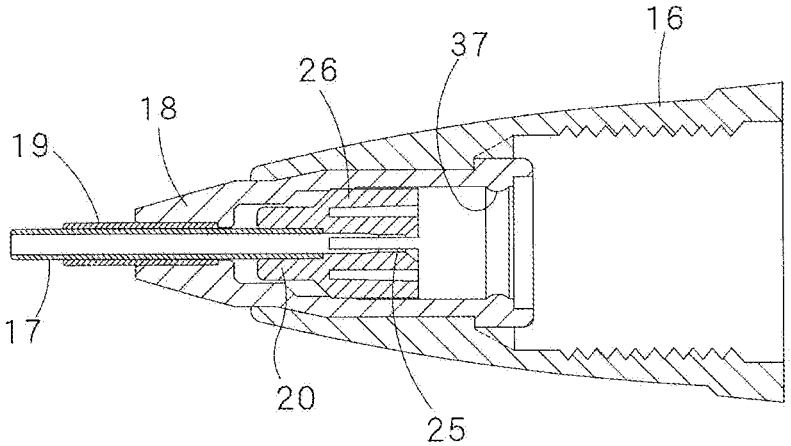
FIG. 9 is an explanatory view showing a state where the slider shown in FIG. 4 and the outer pipe holder shown in FIG. 6 are assembled in a tapered member.
Figure 10:
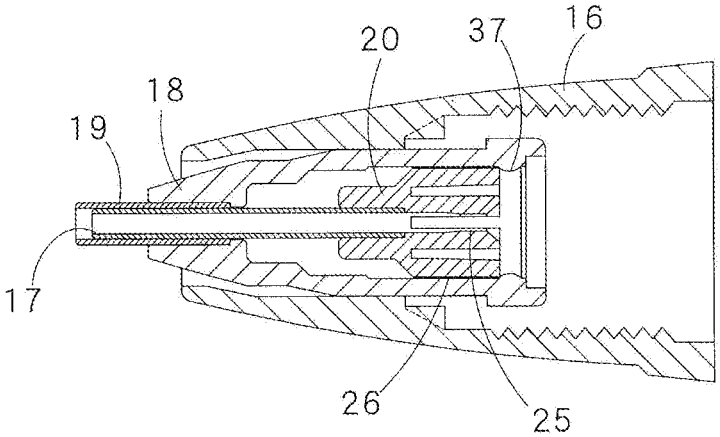
FIG. 10 is an explanatory view showing a state where the outer pipe holder, etc. shown in FIG. 9 are retracted.

To the slider 20 as shown in FIG. 4, the lead protection pipe 17 is fixed, and to the outer pipe holder 18 as shown in FIG. 6, the outer pipe 19 is fixed. Referring to FIG. 9, the lead protection pipe 17 is inserted into the outer pipe 19 so that its front end protrudes from the front end of the outer pipe 19, and the slider 20 is assembled in the outer pipe holder 18 so that the slider 20 is positioned ahead of the raised part 37 provided within the outer pipe holder 18, and this state is set in the tapered member 16. In this state, if an excessively large load is applied to the front end of the lead protection pipe 17, as shown in FIG. 10, the entire lead protection pipe 17 slips into the outer pipe 19 and the rear end of the slider 20 moves backward within the outer pipe holder 18 to the position where the rear end of the slider 20 abuts on the raised part 37, and further the outer pipe holder 18 also moves backward within the tapered member 16.

Figure 11A:
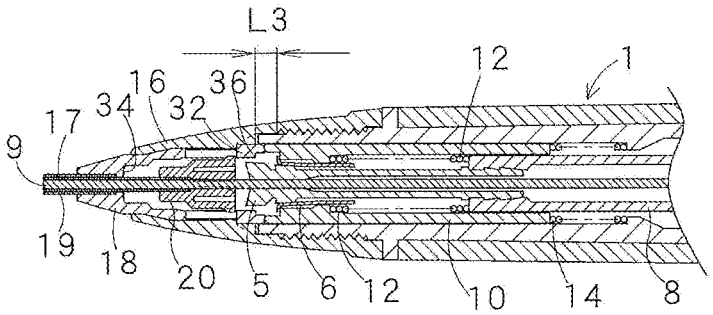
FIGS. 11A, 11B, 11C and 11D are explanatory views, respectively, of a state where a lead protection pipe is housed, a state where knocking is made, a state where a chuck is about to retract, and a writing state.
Figure 11B:
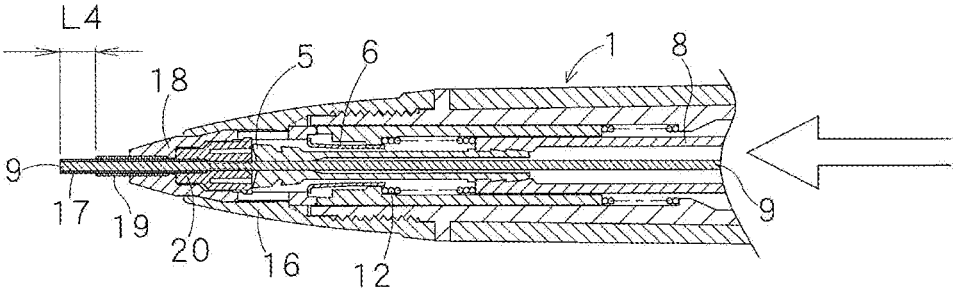

The lead-feeding mechanism of the present invention is shown in FIGS. 11A-11D. FIG. 11A shows a state where the lead protection pipe 17 is hidden in the outer pipe 19 as the writing proceeds. In this state, as shown in FIG. 8 and FIG. 10, the slider 20 is moved backward to a position where it abuts on the stopper part 32 or the raised part 37. At this time, between the front end of the clamping ring 6 and the inward stepped portion 36, there is a gap of a distance L3, and this distance L3 is a lead-feeding distance. That is, when the lead tank 8 is knocked as shown in FIG. 11B, the chuck 5 and the clamping ring 6 move forward, and during forward movement, the clamping ring 6 stops by abutting on the inward stepped portion 36, and the chuck 5 is released. As mentioned above, the lead 9 can be fed until the clamping ring 6 abuts on the inward stepped portion 36, and this distance is a lead-feeding distance. The chuck 5 moves further forward, and moves the slider 20 to the position where it abuts on the stopper part 34, and causes the front end of the lead protection pipe 17 to protrude from the front end of the outer pipe 19. At this time, the distance from the front end of the outer pipe 19 to the front end of the lead protection pipe 17 is a maximum, protrusion distance L4 of the pipe as shown in FIG. 11B.

Figure 11C:
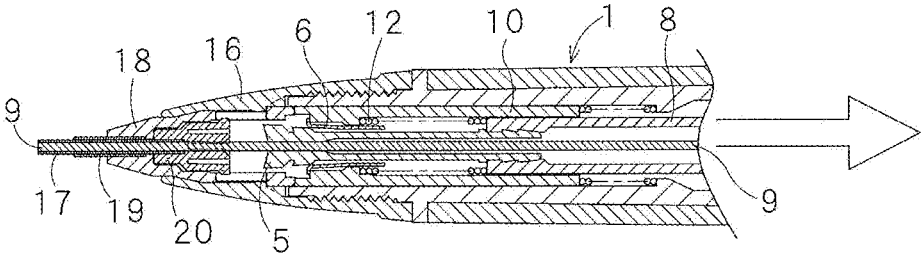
Figure 11D:
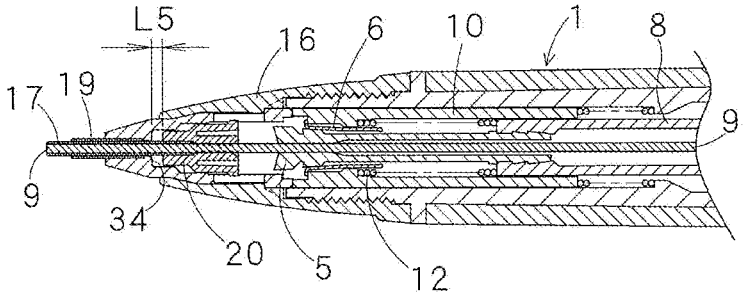

When the knocking is stopped as shown in FIG. 11C, the chuck 5 is moved backward by the chuck spring 12. During backward movement, the chuck 5 gradually slips into the clamping ring 6 and moves backward while closing, whereby the lead 9 is retracted backward. At this time, as shown in FIG. 11D, since the lead weak-holding portion 25 of the slider 20 holds the lead 9 with an extremely weak holding force, the slider 20 also moves backward, and between the front end of the slider 20 and the stopper part 34, a gap equivalent to a lead retraction distance L5 is formed. Although this gap is only a slight amount, the lead 9 is grasped by the chuck 5 and writing can be made without difficulty. Since the slider 20 is not provided with an elastic piece for resistance unlike conventional mechanical pencils, when the chuck 5 moves backward to retract the lead 9 backward, the slider 20 is also retracted. Accordingly, to maintain the writing conditions, the lead-feeding distance L3 should be set to feed the lead considering the lead retraction distance L5. Specifically, in a case where, for example, a lead protrusion distance required for writing is 0.8 mm and the lead retraction distance is 0.7 mm, the lead-feeding distance L3 is set to be 1.5 mm by adding 0.7 mm to 0.8 mm. By doing so, even if the lead is retracted to move backward by 0.7 mm, the distance at issue is 1.5 mm−0.7 mm=0.8 mm, and it is therefore possible to secure 0.8 mm as the lead-feeding distance L3 and writing can be made without difficulty.

Figure 12A:
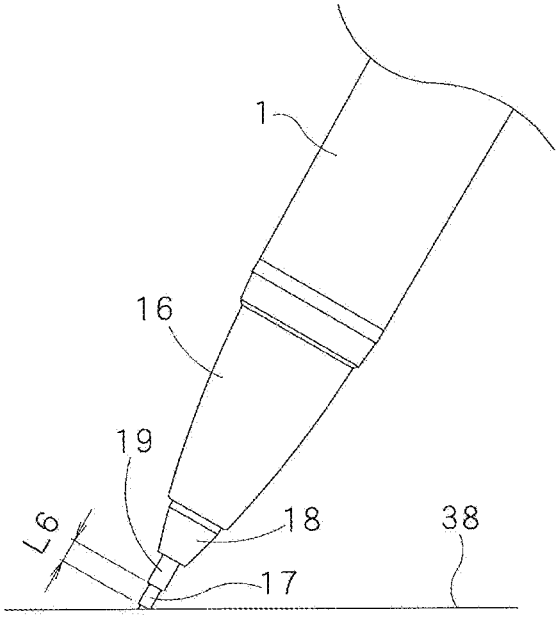
FIG. 12A shows an elevational view when the writing starts and FIG. 12B shows an elevational view when a lead protection pipe retracts.
Figure 12B:
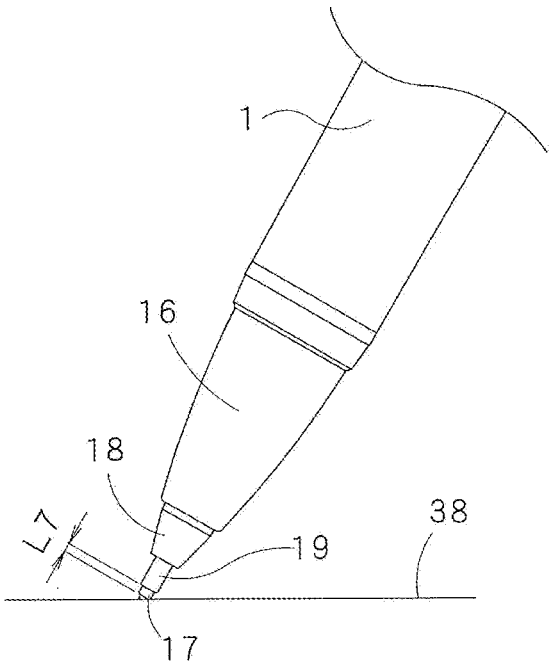

Writing can be conducted under this condition. The lead protection pipe 17 for protecting the lead abuts on a paper face 38 by protruding by a distance L6 as shown in FIG. 12A, and as the lead is worn through use, the lead protection pipe and the slider move backward, and the protrusion distance becomes L7 as shown in FIG. 12B. At the time of backward movement, since the slider 20 has a non-resistant sliding-contact surface 26 on its outer face (see FIGS. 9 and 10), the slider moves without causing resistance with the inner periphery face of the outer pipe holder 18, and therefore substantially no significant dragging resistance is caused. By continuing the writing, the slider 20 moves backward to a position where its rear end abuts on the stopper part 32 as shown in FIG. 11A. When the mechanism is in this condition, by knocking the lead tank 8 as mentioned above, the lead 9 can be fed by one knocking operation as shown in FIGS. 11B, 11C and 11D. At this time, since the outer periphery of the slider 20 has a non-resistant sliding-contact (low friction) surface 26, the slider 20 can be moved forward together with the lead 9 at the time of lead-feeding, and there is no possibility that only the lead 9 may protrude from the front end of the lead protection pipe 17.

With respect to the length of the lead protection pipe 17 that protrudes from the tapered member 16 during writing, in a case of conventional mechanical pencils having no outer pipe 19, the outer periphery of the lead protection pipe 17 is not covered by an outer pipe 19 and substantially the entire length of the lead protection pipe 17 protruding from the tapered member 16 is exposed. On the other hand, in the present invention, since the outer periphery of the lead protection pipe 17 is covered by the outer pipe 19 provided at the tapered member 16, the length of the exposed portion of the lead protection pipe 17 is the same as the length extending from the outer pipe 19, and the length of the exposed portion of the lead protection pipe 17 is shorter than that of conventional mechanical pencils.

When writing, as shown in FIG. 12A, since the main body 1 is gripped slantwise for writing, a slantwise load created by writing pressure is applied to the front end of the lead protection pipe 17, and this load is a bending force tending to bend the lead protection pipe 17. The bending force is equal to "a load applied to the front end of the lead protection pipe 17"×"a length of extended portion of the lead protection pipe". Since the front end of the lead protection pipe of the present invention protrudes from the front end of the outer pipe as mentioned above, the protruded length can be made shorter than that of conventional ones where no outer pipe is provided and the lead protection pipe is directly exposed from the tapered member. The bending force applied to the lead protection pipe 17 can thereby be made small. Accordingly, the friction resistance applied when the lead protection pipe 17 and the slider 20 move backward can be reduced, the straight movement of the slider 20 is secured, and lead breakage can be satisfactorily prevented.

Further, movement of the lead protection pipe 17 is guided by the outer pipe 19 and therefore its guided length is longer than that of conventional mechanical pencils having no outer pipe 19. Therefore, the deviation of the lead protection pipe 17 and the slider 20 becomes small, and backward movement can be conducted under stable conditions, whereby prevention of lead breakage can be further improved. When the mechanical pencil is dropped, the lead protection pipe 17 moves backward into the outer pipe 19 and the front end of the lead protection pipe 17 can be protected.

Figure 13A:
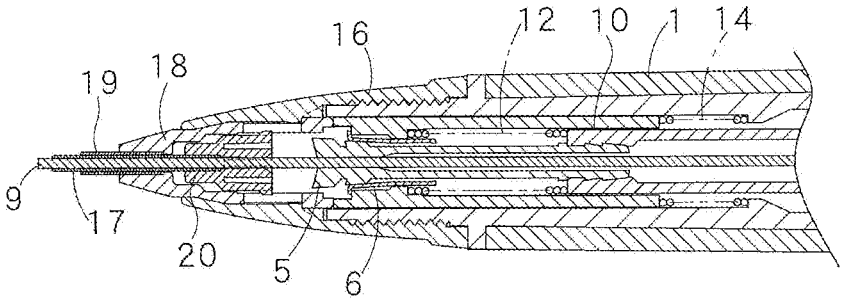
FIG. 13A and FIG. 13B show, respectively, a writing state and a state where a cushion spring is compressed.
Figure 13B:
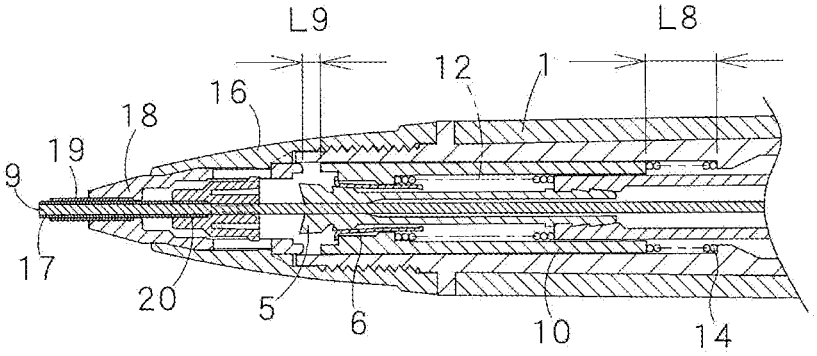
Figure 14A:
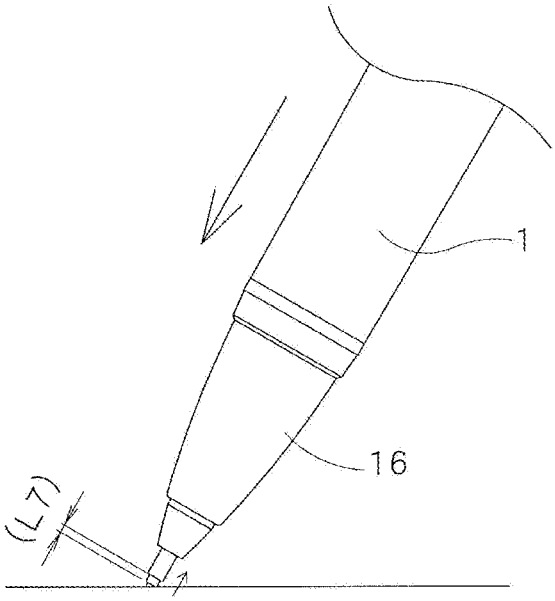
FIG. 14A and FIG. 14B are elevational views showing, respectively, a state where the cushion spring compresses and the lead protection pipe retracts and a state where the cushion spring extends and the lead protection pipe returns to the writing state.

In the example shown in FIG. 1, a cushion spring 14 is disposed behind the holding tube 10 and provides an appropriate cushion function when an excessively large writing pressure is applied. With reference to FIG. 13A, a lead 9 is gripped by the chuck 5 and the clamping ring 6 (see FIG. 1). Under this condition, when an excessively large load is applied to the front end of the lead 9, as shown in FIGS. 13B and 14A, the lead protection pipe 17 and the slider 20 move backward via the lead 9 (see FIG. 14A), and concurrently the holding tube 10 housing the chuck 5 and the clamping ring 6 moves backward while compressing the cushion spring 14 as shown in FIG. 13B. At this time, the length of the cushion spring 14 is compressed to a distance L8, and a gap L9 is formed between the outer pipe holder 18 and the holding tube 10.

Figure 14B:
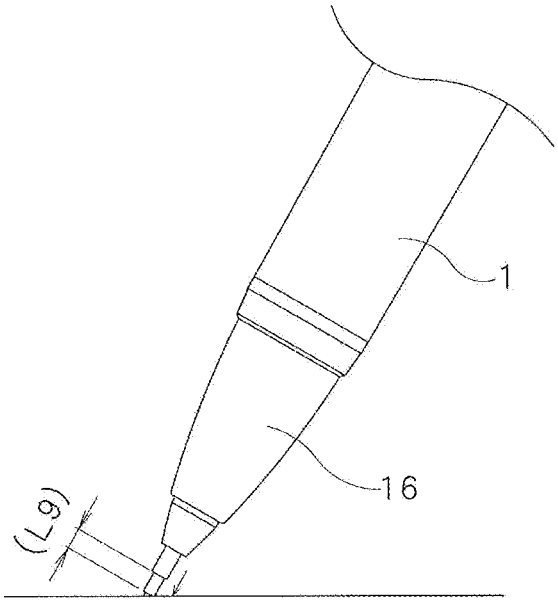
Figure 15A:
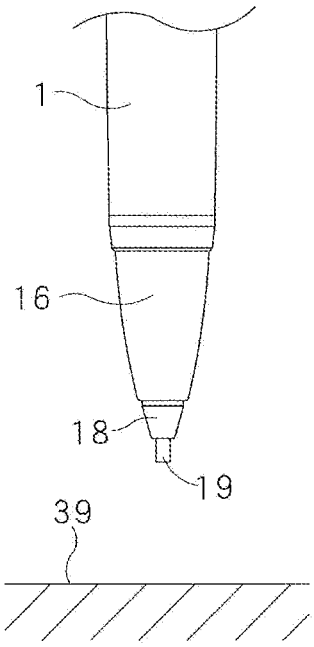
FIG. 15A is an elevational view of a state where the lead protection pipe is housed in the outer pipe.
Figure 15B:
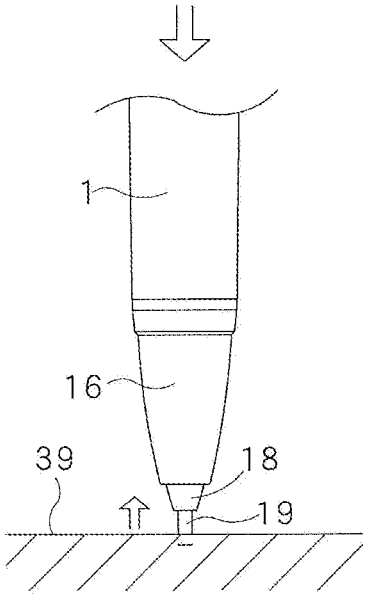
FIG. 15B is an elevational view of a state where the mechanical pencil drops.
Figure 15C:
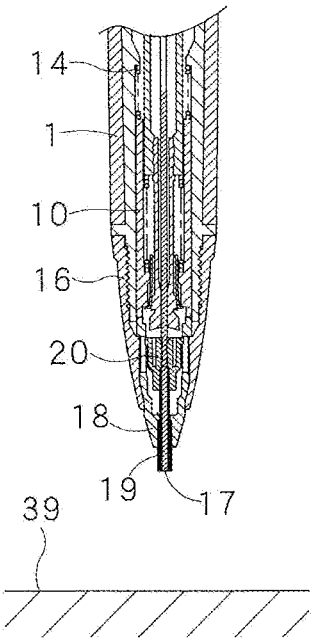
FIG. 15C is an explanatory view of a state where the lead protection pipe is housed.
Figure 15D:
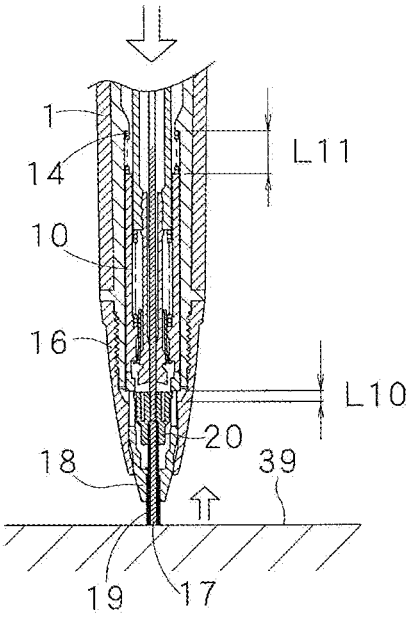
FIG. 15D is an explanatory view of a state where the mechanical pencil drops.
Figure 17A:
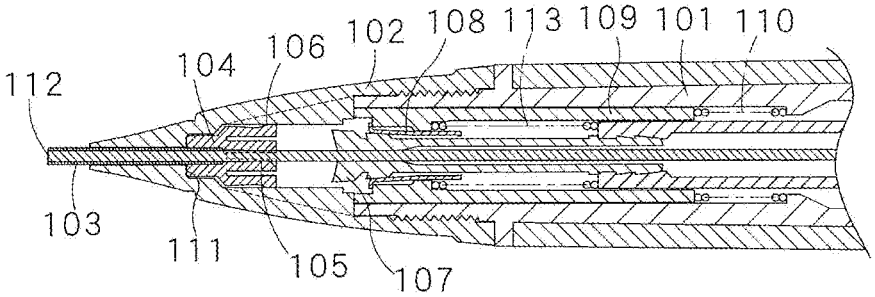
FIGS. 17A, 17B and 17C are explanatory views, respectively, of a writing state, a state where the lead retracts when an excessively large load is applied to the front end of the lead protection pipe, and a state where the excessively large load is released.
Figure 17B:
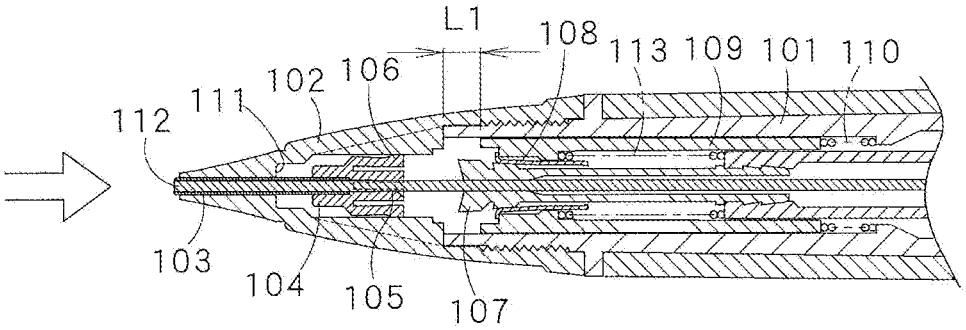
Figure 17C:
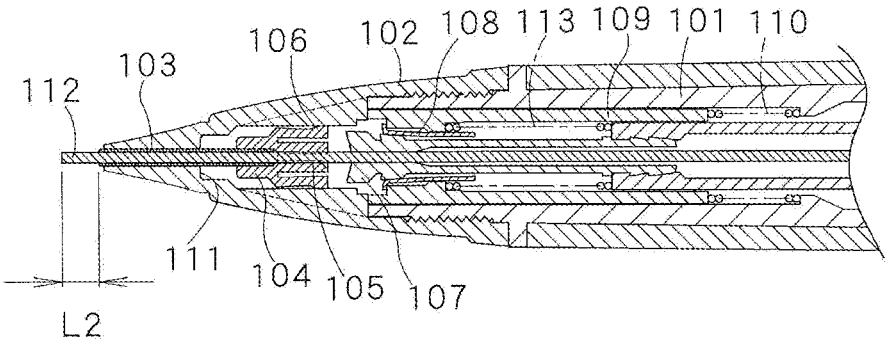

When the excessively large load disappears, the holding tube 10 moves forward to close the gap L9 by the action of the cushion spring 14, the slider 20 and the lead protection pipe 17 move forward the same distance, and the mechanism returns to the writing condition shown in FIGS. 13A and 14B. At this time, since no elastic piece for resistance is provided at the outer periphery of the slider 20, the slider 20 moves forward together with the lead 9. Accordingly, unlike the conventional mechanical pencil shown in FIG. 17C, there is no possibility that the slider 20 stops part way during movement in the tapered member whereby only the front end of the lead unwantedly protrudes, and therefore reliable protection can be secured up to the front end of the lead by the lead protection pipe.

FIG. 15 shows a protection mechanism for the outer pipe 19. In this example, an outer pipe holder 18 is inserted to undergo back and forth movement in a tapered member 16. As shown in FIG. 15A and FIG. 15C, a lead protection pipe 17 is housed in the outer pipe 19. In this state, when the main body is dropped on a floor 39, as shown in FIG. 15B and FIG. 15D, the outer pipe holder 18 to which the outer pipe 19 is fixed moves backward by a distance L10 within the tapered member 16, abuts on a holding tube 10, and moves the holding tube 10 backward against a cushion spring 14. The cushion spring 14 compresses to a length L11. By the buffering effect of the cushion spring 14, the outer pipe 19 is protected from breaking, and when the pencil is raised from the floor, by the action of the cushion spring 14, the holding tube 10 and the outer pipe holder 18 move forward and the mechanism returns to the original state.

Figure 16:
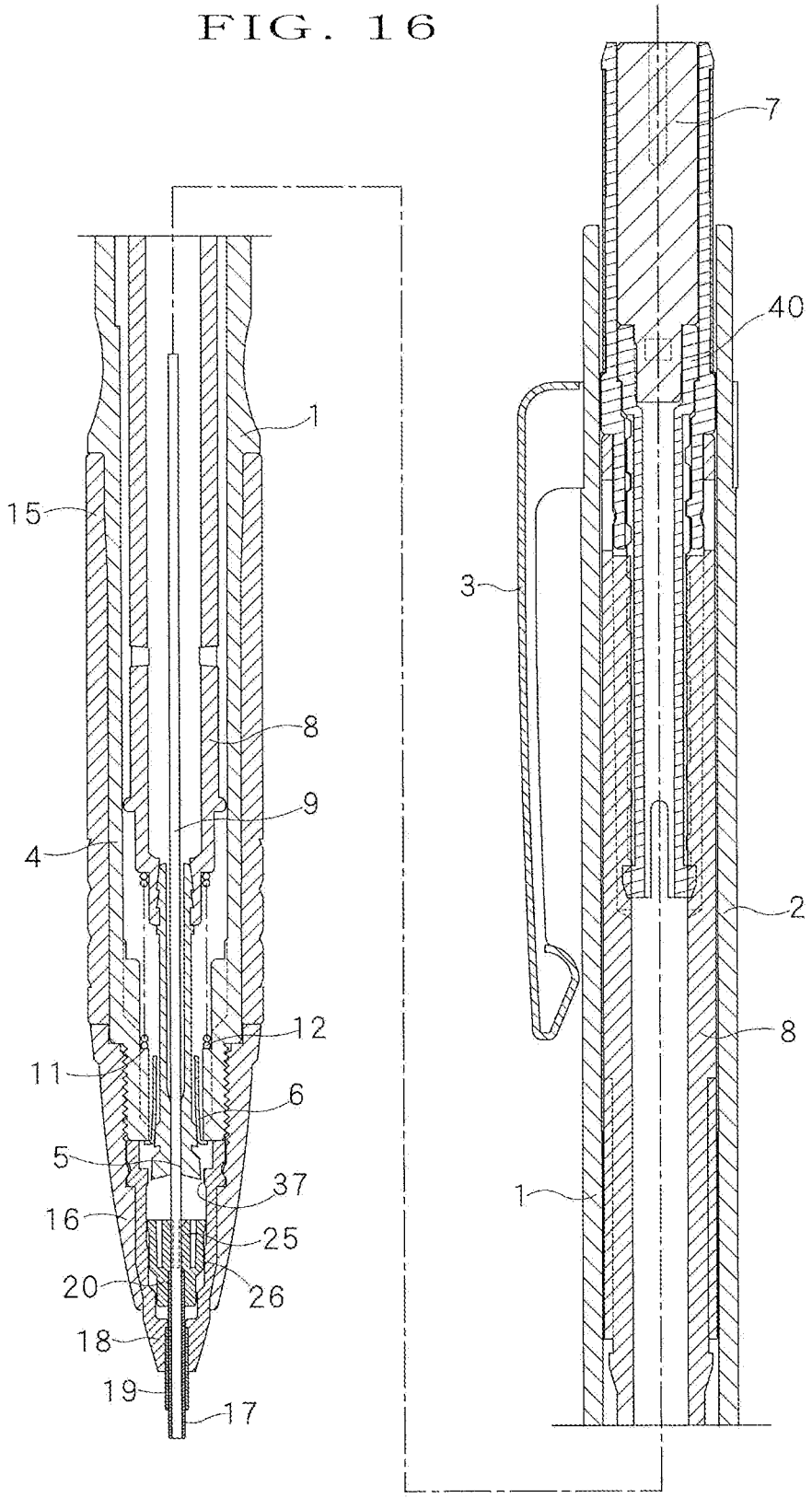
FIG. 16 is a cross-sectional view of a mechanical pencil not provided with a cushion mechanism.

In the above example, the cushion mechanism is provided, but the cushion mechanism may be omitted. FIG. 16 shows this example, and since this example basically has the same structure as the example shown in FIG. 1, common parts are indicated by the same reference numerals for explanation. A main body 1 is formed in a tubular shape, its rear portion 2 has a clip 3 at the outside, and a grip 15 is provided at the outer periphery of a front portion 4 which has an inner diameter smaller than that of the rear portion 2. At the front end of the front portion 4, a chuck 5 and a clamping ring 6 are housed to undergo back and forth movement, and the rear part of the chuck 5 is connected to a lead tank 8 housed in the main body 1. Between the front portion of the lead tank 8 and an inward stepped portion 11 formed within the front portion of the main body, a chuck spring 12 is provided to urge the chuck 5 rearwardly. At the rear end of the lead tank 8, a conventional eraser-feeding mechanism 40 is provided and removably holds an eraser 7. Alternatively, the eraser may be mounted at the rear end of the lead tank as shown in FIG. 1. At the front portion 4 of the main body 1, a tapered member 16 is threadedly mounted and an outer pipe 19 is inserted into and fixed to the tapered member 16. In the outer pipe holder 18, a slider 20 is movably inserted to undergo back and forth movement, and at the front end of the slider 20, a lead protection pipe 17 is fixed. The lead protection pipe 17 is movably inserted to undergo back and forth movement in the outer pipe 19 and protrudes from the front end thereof.

Inside the slider 20, a lead weak-holding portion 25 for temporarily holding the lead 9 is provided. The lead weak-holding portion 25 is tubular-shaped and provided with one or more longitudinal slits to add flexibility to the lead weak-holding portion 25 so that it can elastically hold the lead 9. Alternatively, the lead weak-holding portion 25 may be formed by an elastic material such as a rubber material (not shown). The lead-holding force exerted by the lead weak-holding portion 25 is set to be far weaker as compared to conventional mechanical pencils. Specifically, when the front end of the main body 1 is directed downward, the lead-holding force is slightly greater than the force necessary to prevent the lead from dropping by its own weight. By way of example, a gram-force of a few grams has been found effective to provide a holding force sufficient to ensure that the lead does not drop by its own weight. That is, the load is set to be such a level that even if writing is conducted while dragging the lead protection pipe 17 on the writing surface, no hindrance to writing occurs. Further, on the outer face of the slider 20 is formed a non-resistant sliding-contact surface 26 which slidingly contacts the inner face of the outer pipe holder 18 with substantially no resistance. On the inner face of the outer pipe holder 18, a raised part 37 is provided to prevent detachment of the slider 20.

In the above structure, when the lead tank 8 is knocked, the chuck 5 moves forward and the lead 9 is fed. When the knocking is stopped and the chuck 5 moves backward, the chuck 5 slips into the clamping ring 6, and concurrently the lead 9 is retracted. Therefore, the distance of feeding the lead by the knocking operation is determined taking into account the retraction distance. That is, the lead feeding distance is a distance obtained by adding the lead-retracting distance to the protrusion amount of the lead necessary for writing. By doing so, when the chuck moves backward, even if the lead 9 is retracted rearwardly, a length necessary for writing can be secured and writing can be conducted without difficulty.

By employing the above structure, the mechanical pencil shown in the example of FIG. 16 can move the slider 20 and the lead protection pipe 17 forward to feed the lead 9 by one knocking operation. As the writing proceeds, since the slider 20 and the lead protection pipe 17 move backward without generating resistance, even if writing is conducted while dragging the lead protection pipe 17, no uncomfortable feeling is given to the user and writing is not hindered. Further, since the outer periphery of the lead protection pipe 17 is covered by the outer pipe 19, the lead protection pipe 17 can endure the bending force exerted on its front end on writing, and is hardly bent, whereby lead breakage can be prevented.

It will be appreciated by those of ordinary skill in the art that obvious changes, alterations and modifications can be made to the examples and embodiments described in the foregoing description without departing from the broad inventive concept thereof. It is understood, therefore, that this disclosure is not limited to the particular examples and embodiments disclosed, but is intended to cover all obvious changes, alterations and modifications thereof which are within the scope and spirit of the disclosure as defined by the appended claims.

What is claimed is:

1. A mechanical pencil having a lead breakage-prevention mechanism, comprising: a main body housing a lead-feeding mechanism which includes a chuck and a clamping ring; a tapered member provided at a front end of the main body; a slider disposed to undergo back and forth movement within the tapered member; a lead protection pipe carried by the slider and protruding from a front end of the tapered member when the slider moves forward; and an outer pipe provided at a front end of the tapered member and surrounding the front end of the lead protection pipe, wherein the slider has, on its outer face, a non-resistant sliding-contact face which slidingly contacts an inner face of the tapered member, and has on its inner face, a lead weak-holding portion which exerts a weak holding force on the lead sufficient to hold the lead fed by the chuck so the lead does not drop by its own weight.

2. The mechanical pencil having a lead breakage-prevention mechanism according to claim 1; wherein when the chuck and the clamping ring are moved forward to feed the lead, the lead-feeding distance is a distance obtained by adding a lead-retracting distance when the chuck slips into the clamping ring to a protrusion amount of the lead necessary for writing.

3. The mechanical pencil having a lead breakage-prevention mechanism according to claim 1; wherein the lead-holding force of the lead weak-holding portion is at such a level that no hindrance to writing is caused even if the writing is made while dragging the lead protection pipe on the writing surface.

4. The mechanical pencil having a lead breakage-prevention mechanism according to claim 1; wherein the outer pipe is fixed to the tapered member.

5. The mechanical pencil having a lead breakage-prevention mechanism according to claim 1; wherein the outer pipe is provided on an outer pipe holder inserted into the tapered member.

6. The mechanical pencil having a lead breakage-prevention mechanism according to claim 5; wherein the outer pipe holder is disposed to undergo back and forth movement, a rear end of the outer pipe holder faces a holding pipe which holds the chuck and the clamping ring, and the holding pipe is urged forward by a cushion spring having a spring pressure larger than a writing pressure.

* * * * *